United States Patent [19]

Campioli

[11] Patent Number: 4,848,227

[45] Date of Patent: Jul. 18, 1989

[54] DEVICE FOR THE SILK-SCREEN PRINTING OF CYLINDRICAL OBJECTS HAVING AN ELLIPTICAL CROSS-SECTION

[75] Inventor: Emore Campioli, Reggio Emilia, Italy

[73] Assignee: S.p.A. O.M.S.O. -- Officina Macchine per Stampa su Oggetti, Reggio Emilia, Italy

[21] Appl. No.: 177,673

[22] Filed: Apr. 5, 1988

Related U.S. Application Data

[63] Continuation of Ser. No. 930,952, Nov. 12, 1986, abandoned, which is a continuation of Ser. No. 357,820, Mar. 15, 1982, abandoned.

[30] Foreign Application Priority Data

Apr. 16, 1981 [IT] Italy ..... 46831 A/81

[51] Int. Cl.[4] ..... B41F 17/08

[52] U.S. Cl. ..... 101/39; 101/123

[58] Field of Search ..... 101/38 A, 39, 40, 123, 101/124, 126

[56] References Cited

U.S. PATENT DOCUMENTS

| | | | |
|---|---|---|---|
| 3,286,624 | 11/1966 | Dubuit | 101/40 |
| 3,533,353 | 10/1970 | Dubuit | 101/40 |
| 3,810,422 | 5/1974 | Kammann | 101/40 |
| 4,109,573 | 8/1978 | Strauch et al. | 101/123 X |
| 4,184,427 | 1/1980 | Bubley et al. | 101/123 |
| 4,233,897 | 11/1980 | Lala | 101/123 |
| 4,282,806 | 8/1981 | Lala | 101/123 X |
| 4,304,180 | 12/1981 | Lala et al. | 101/40 |

FOREIGN PATENT DOCUMENTS

| | | | |
|---|---|---|---|
| 2060731 | 6/1972 | Fed. Rep. of Germany | 101/40 |
| 2419247 | 11/1975 | Fed. Rep. of Germany | 101/40 |
| 2714652 | 10/1977 | Fed. Rep. of Germany | 101/38 A |

*Primary Examiner*—Edgar S. Burr
*Assistant Examiner*—Moshe I. Cohen
*Attorney, Agent, or Firm*—Birch, Stewart, Kolasch & Birch

[57] ABSTRACT

A flat frame is arranged to reciprocate vertically and parallel to the travel strokes of two overlying carriages, namely a screen support carriage and an ink knife support carriage respectively. On the free end of the frame a mandrel is provided for longitudinally gripping the objects to be. A spindle is provided with a toothed element at its rear end which is rotatably mounted by of its own pivot on the ink knife support carriage.

The pitch circle diameter of the toothed element coincides with the diameter of the receiving cylindrical surface of the objects to be printed, and the toothed element is in constant engagement with a further toothed member on a lower side of a screen support carriage.

The device is suitable for silkscreen printing machines in general, and especially for printing cylindrical objects having an elliptical cross-section.

4 Claims, 3 Drawing Sheets

DEVICE FOR THE SILK-SCREEN PRINTING OF CYLINDRICAL OBJECTS HAVING AN ELLIPTICAL CROSS-SECTION

This application is a continuation of copending application Ser. No. 930,952 filed on Nov. 12, 1986, abandoned, which is a continuation of application Ser. No. 357,820 filed on Mar. 15, 1982, now abandoned.

This invention relates to a device for silk-screen printing machines whereby the machine can correctly carry out printing on cylindrical objects having an elliptical cross-section.

It is known that in order to correctly print any image on a cylindrical surface having an elliptical cross-section, it is necessary to literally "roll" this surface over the working face of the silk screen. In other words, the surface must be rotated about its own center of curvature, which is obviously different from the longitudinal axis of the object to be printed.

Suitable devices are used for printing such cylindrical objects of elliptical or polycentric cross-section.

A device is known inter alia which comprises a vertical plate branching from the ink knife support carriage of the silk-screen printing machine to which it belongs, and provided with an adjustable transverse pin.

On this device, a double grooved wheel is rotatably mounted which, by means of a set of clamps, supports a second vertical plate in such a manner that it can be adjusted and from which branches a breech member for receiving one end of the objects to be printed.

In such known devices, the axis of the aforesaid transverse pin constitutes the center of curvature of the cylindrical surface to be printed.

In addition, two flexible members are partly wound in opposite directions in the two grooves of said double grooved wheel, and are connected to the opposing ends of a vertically reciprocating horizontal bar.

The widespread use of the aforesaid devices has, however underlined their excessive complexity, their consequent difficulty of adjustment, the excessive number of component parts, and their high cost.

The most serious drawbacks are without doubt due to the complexity and difficulty of adjusting such devices when it is required to pass from printing on objects with a determined curvature to printing on cylindrical objects having different curvatures.

In this respect, in such cases, the transverse pin must be correctly positioned, the double grooved wheel must be replaced, this wheel must be adjusted along the second vertical plate, the two flexible members must be removed from the withdrawn wheel and then mounted on the new wheel, and said two flexible members must be put under correct tension.

It should also be noted that in order to prevent blurring of the printed images, said operations must be carried out with maximum care, precision and correctness. This is very difficult because of the large number of elements to be correctly adjusted, both with respect to the corresponding silk-screen printing machine and with respect to the other elements or members of the device to which they pertain.

This obviously results in long operating times and in a lack of production of printed objects, with obvious consequences in terms of the cost of the finished product and the economical running of the firm.

Finally, the aforesaid problems are more serious when the production of printed objects is diversified, i.e. objects with receiving surfaces of different curvatures.

Finally, further constructional complexities of said known devices are due to the fact that the loading and unloading of the objects onto and from the printing mandrel are carried out in two different zones of the corresponding machine.

SUMMARY OF THE INVENTION

The main object of the present invention is to provide a device for the silk screen printing of cylindrical objects having an elliptical cross-section, which enables the aforesaid drawbacks to be obviated by means of a simple and rational constructional design.

According to the invention, the proposed device comprises a flat frame pivoted at one end to the corresponding silk-screen machine so that it lies below a normal screen support carriage. At its opposite end, a mandrel is disposed for gripping the objects to be printed. The device has a rotational spindle is controlled by a toothed member having a pitch circle which corresponds to the curvature of the cylindrical surface to be printed, and which is tangential to the plane in which the silk screen lies.

The toothed member is rotatably mounted on the ink knife support carriage, and engages with a second toothed member provided on the screen support carriage in order to drive this latter in phase opposition to the ink knife support carriage, so as to make the rectilinear travel strokes of the ink knife identical to the rotational arcs of the first toothed member, i.e., in order to obtain perfect rolling of the surface to be printed over the active face of the printing screen.

The mandrel comprises a breech member and a counter-point which are mutually mobile in order to approach and withdraw from each other, and are controlled in synchronism with the operating stages of the corresponding silk-screen printing machine by respective lever mechanisms provided on said flat frame.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The characteristics and constructional merits of the invention will be more apparent from the detailed description given hereinafter with reference to the figures of the accompanying drawings which illustrate a particular preferred embodiment of the device according to the invention by way of non-limiting example and in which.

DETAILED DESCRIPTION OF THE PREFERRED EMBODIMENT

Figure 1:
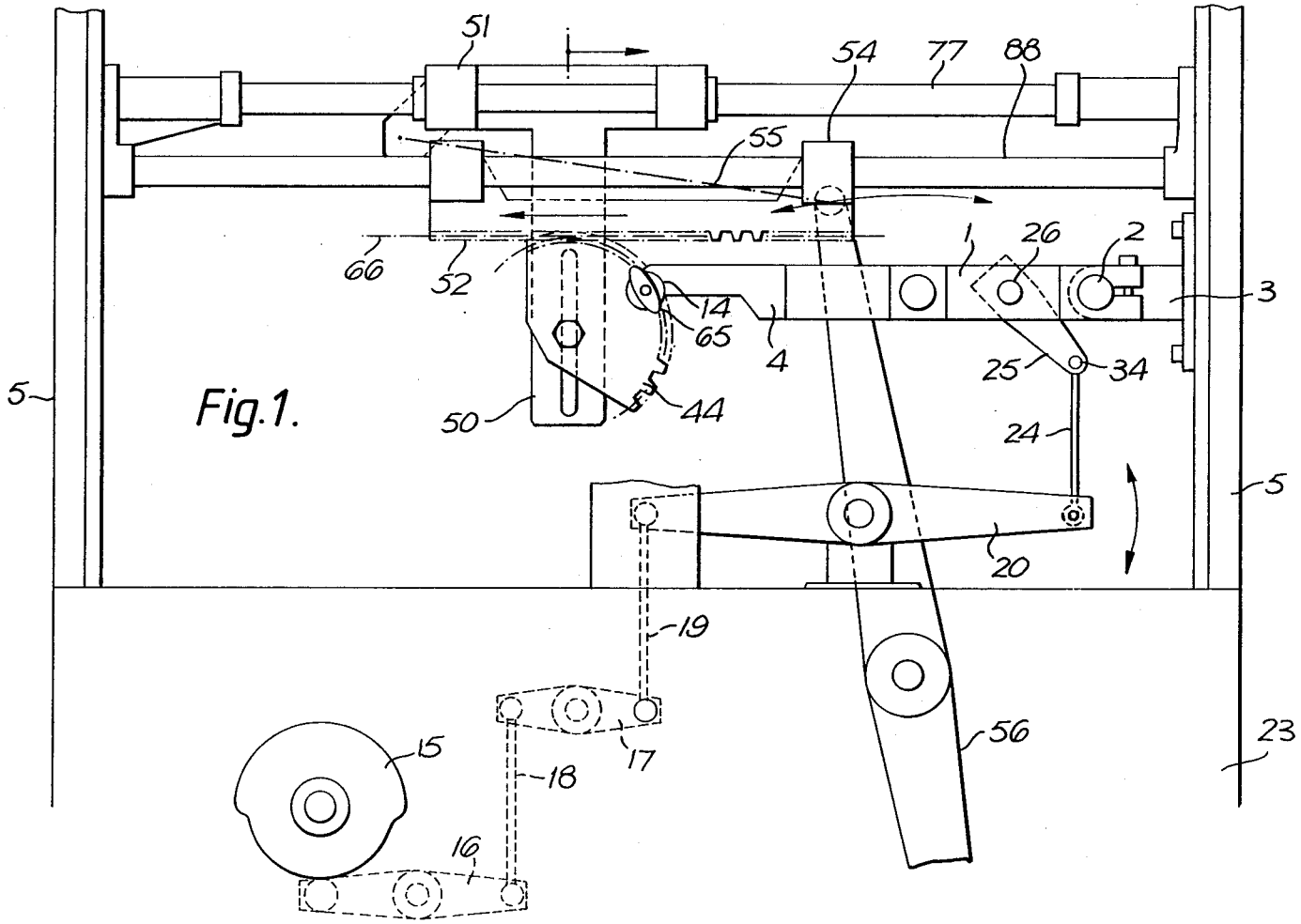
FIG. 1 is a front view of the invention.

In the figures, and in particular in FIG. 1, a base 23 of a normal silk-screen printing machine is shown from which two opposing side walls 5 rise.

The tops of these walls 5 support a first pair of horizontal cylindrical bars 77 which overly a second pair of horizontal cylindrical bars 88, also.

Figure 3:
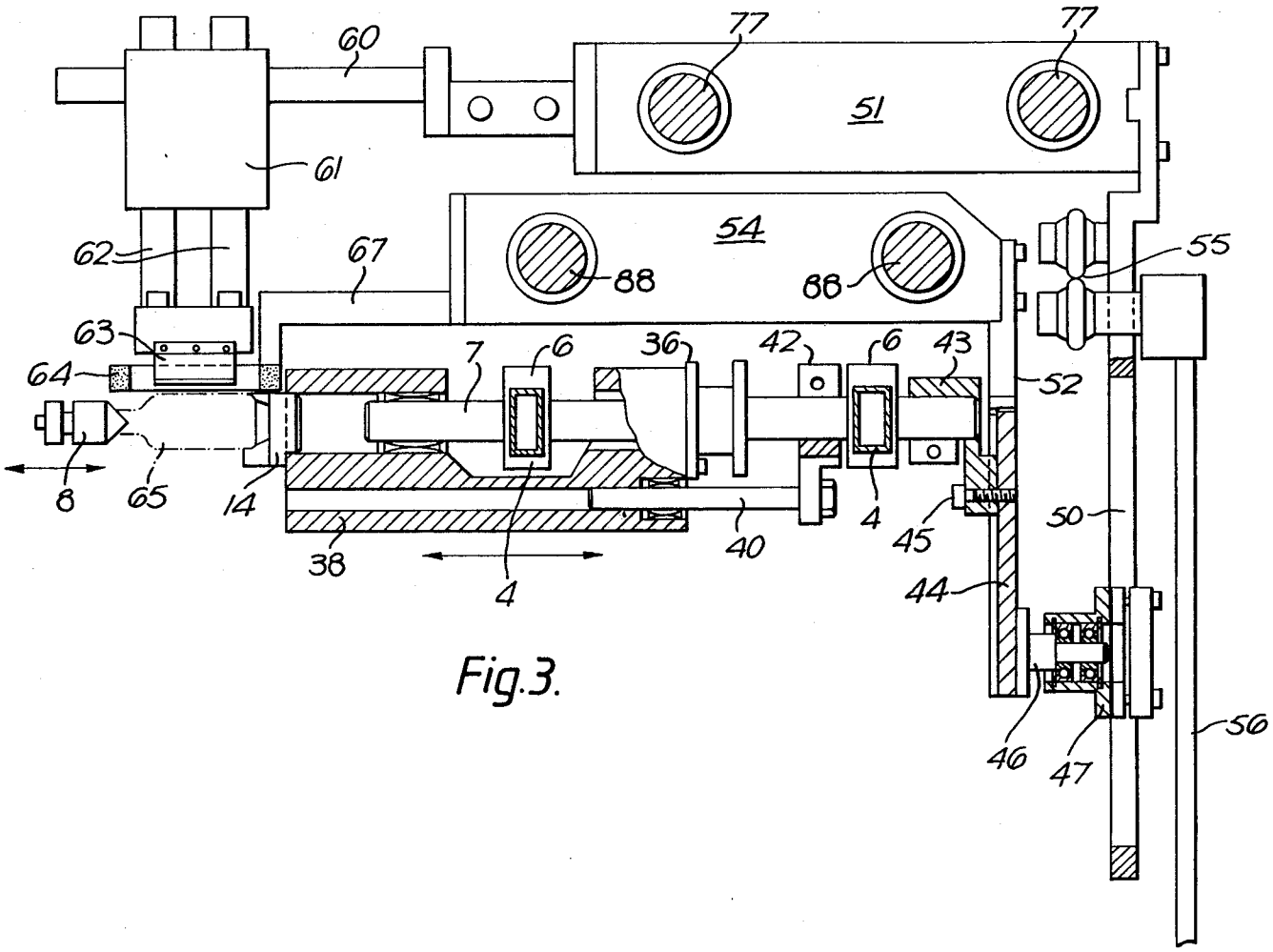
FIG. 3 is a vertical cross-section through the device according to the invention.

As can also be seen from FIG. 3, on the cylindrical bars 77 an ink knife support carriage 51, is slidably mounted. The front edge of the knife support carriage 51 has two horizontal rods 60 extending therefrom.

A block 61 is disposed on these latter in such a manner that its operating position can be adjusted. The block 61 has two vertical rods 62 which are adjustable in height and are provided with at least one ink knife 63 at their lower end.

On the cylindrical bars 88, a screen support carriage 54 is slidably mounted. The front edge of carriage 54 has a bracket 67 for supporting a normal screen 64, above which the aforesaid ink knife 63 lies.

On a horizontal axis disposed transversely to the bars 77 and 88, there is hinged to the bottom of the base 23 (FIG. 1) a rocker arm 56, the lower end of which derives motion from the main drive of the printing machine by way of a suitable control crank or another equivalent eccentric device.

By way of a suitable connecting rod 55, the top end of said rocker arm 56 controls the rectilinear reciprocating motion of the ink knife support carriage 51 along the bars 77.

Below the cylindrical bars 88, on the inner face of the side wall 5 which is shown to the right in FIG. 1, a horizontally lying fork support 3 is fixed. On the arms of support 3, a shaft 2 is idly mounted.

This shaft 2 is disposed transversely to the overlying bars 77 and 88, and its opposing ends emerge beyond the arms of said fork support 3.

Figure 2:
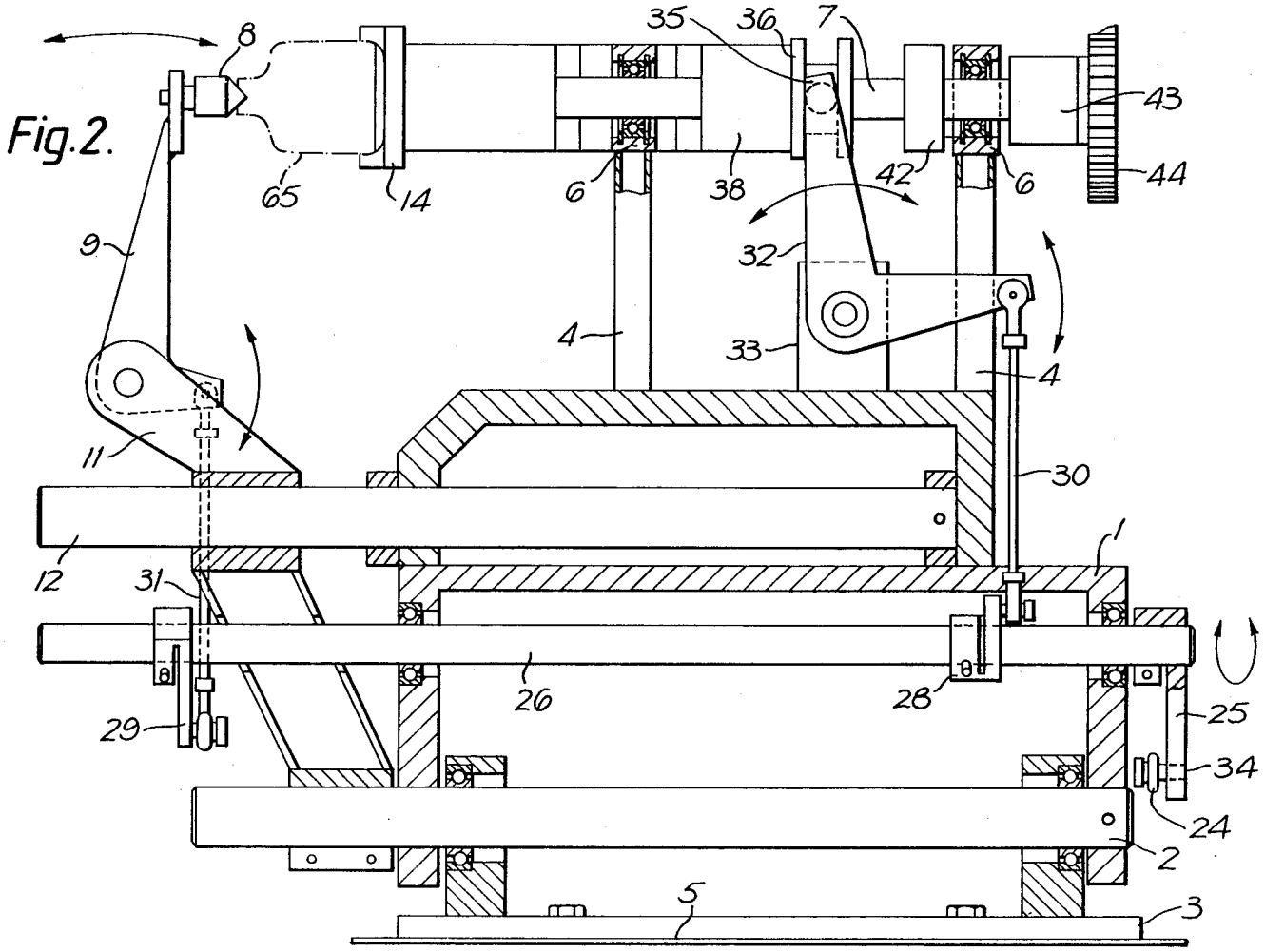
FIG. 2 is a view of the invention from above.

On the ends, there is fixed the outer part of a flat profiled frame 1, from the free end of which two arms 4 extend orthogonally to the shaft 2, as is seen in FIG. 2.

Each individual arm 4 comprises an end support 6 where a horizontal spindle 7 is rotatably mounted parallel to the shaft 2.

Said horizontal spindle 7 is locked axially relative to the end supports 6 known manner.

From the accompanying FIG. 3, it can be seen that on the rear end of the horizontal spindle 7 a member 43 is fixed which extends downwards by way of an appendix comprising a suitable rear rib.

This member 43 is inserted into a corresponding radial groove located in the front face of a toothed ring sector 44 which is fixed on the member 43 by means of a screw 45.

The toothed sector 44 is orthogonal to the spindle 7, and is provided at its rear, in a position corresponding with its longitudinal axis, with a coaxial pin 46 which is rotatably mounted relative to a clamp 47.

This clamp 70 is inserted and locked in such a manner that its level can be adjusted, in a longitudinal slot provided in a vertical plate 50 which extends from the rear edge of the ink knife support carriage 51.

Again with reference to FIG. 3, it can be seen that the toothed sector 44 engaged constantly with a horizontal rack sector 52 which is fixed on the rear edge of the screen support carriage 54.

The rack 52 is orthogonal to the spindle 7.

On the inside of the rear support 6, there is fixed on the spindle 7 a horizontal plate 42 which, as again shown in FIG. 3, extends below the spindle 7 where it carries, fixed thereon, a guide bar 40 disposed parallel to said spindle 7 and extending towards the front support 6.

On the two parts of the spindle 7 which are disposed symmetrically about said front support 6, a slide 38 is slidably mounted on both the spindle 7 and the guide bar 40 so that it is torsionally constrained to the spindle 7.

The front edge of said slide 38, which is disposed immediately below the screen 64, is provided with a breech member 14 for receiving the base of the objects 65 to be printed, which in this specific case have been represented in the form of a small cylindrical bottle of elliptical cross-section.

In front of the breech member 14, and aligned with it and with the spindle 7, an idle counter-point 8 is disposed to be partially inserted into the mouth of the containers 65 in order to clamp them against the breech member 14.

The idle counter-point 8 is mounted at the end of a bell crank lever 9, which lies in a plane parallel to that of the frame 1.

Said bell crank lever 9 is pivoted in its angular zone to the free end of a support 11, which is mounted, in such a manner that it can be adjusted longitudinally, on the front end of the shaft 2 and on the front end of a second shaft 12 which is parallel to shaft 2.

The shaft 12 is fixed on the flat frame 1 immediately within the arms 4.

Said adjustment of the support 11 enables the distance between the counter-point 8 and breech member 14 to be matched to different lengths of the objects 65.

A third shaft 26, the front end of which passes freely through the support 11, is rotatably mounted on the flat frame 1 between said shafts 2 and 12 and parallel thereto.

Beyond frame 1, a clamp 29 is provided on the shaft 26 from which a connecting rod 31 extends. The rod 31 is connected to the other end of the bell crank lever 9 in order to swivel the counter-point 8.

It will be apparent at this point that the clamp 29 enables the operating position of the connecting rod 31 to be adjusted according to the position occupied by the support 11.

Likewise, on the rear end of the shaft 26, a clamp 28 is fixed from which a connecting rod 30 extends. The rod 30 is connected to one end of a rear bell crank lever 32.

The lever 32 is pivoted to an appendix 33 attached to the flat frame 1 and lying between the two arms 4.

The other end of the bell crank lever 32 extends towards the rear of the spindle 7, where it comprises a fork, the arms of which are each provided internally with an idle roller 35.

The pair of rollers 35 sits in the outer circumferential groove of a collar 36 which is mounted slidably on the spindle 7 and is fixed to the rear end of the slide 38.

By means of the two lever mechanisms heretofore described, the counter-point 8 and breech member 14 are caused to mutually open and close in perfect synchronism with the operating stages of the printing machine to which the objects are fed by way of a suitable device, for example of the type comprising stepwise transfer of said objects.

The device according to the invention is loaded and unloaded by known means, for example by sucker members and gripper members, respectively.

With reference to the accompanying FIG. 2, it can be seen that said counter-point 8 and breech member 14 are operated by a lever 25 which is fixed on to the rear end of the shaft 26.

As can be better seen in FIG. 1, said lever 25 derives its rocking motion from the main printing machine drive, by way of a first connecting rod 24, a first rocker arm 20, a second connecting rod 19, a second rocker arm 17, a third connecting rod 18 and a third rocker arm 16. The free end of this arm 16 is constantly in contact with a cam 15 located in the base 23.

The reference numeral 34 indicates the horizontal hinging axis between the lever 25 and first connecting rod 24. The axis 34 is designed to become perfectly aligned with the longitudinal axis of the shaft 2 during the printing stages.

The alignment is extremely advantageous in that during said printing stages, it prevents the counter-point 8 and breech member 14 from being subjected to mutual movements because of the vertical reciprocating movements to which the flat frame 1 is subjected.

In addition, the reference numeral 66 of FIG. 1 indicates the horizontal plane in which the lower working face of the screen 64 lies, said plane 66 also constituting the plane in which the intermediate axis of the toothing of the rack 52 lies.

Again with reference to FIG. 1, the intermediate diameter of the toothed sector 44 defines a cylindrical surface which contains the generating lines of the surface receiving the objects 65 to be printed. The intermediate diameter is constantly tangential to the aforesaid plane 66.

From the detailed description given heretofore, the operation of the device according to the invention is obvious.

A first necessary clarification is the fact that the operating mandrel 8, 14 is both loaded and unloaded at the same point of the printing machine, and the printing stage takes place during the travel stroke in which the ink knife support carriage 51 moves towards the right.

During said travel strokes towards the right, the toothed sector 44 rotates in a counterclockwise direction, so that the screen support carriage 54 slides towards the left through a distance corresponding to the difference between the total arc traversed by the pitch circle diameter of the toothed sector 44 and the total right hand stroke made by the ink knife support carriage 51.

In this manner, the axes of the objects 65 move only vertically, and the surfaces receiving said objects roll over the working surface of the screen 64 without sliding thereon, so that the printing ink is transferred without any blurring of the images.

Finally, the device according to the invention is provided with a set of toothed sectors 44, of which the pitch circle diameters correspond to a group of different curvatures of the receiving cylindrical surfaces of the objects 65 to be printed.

The adjustment and preparation of the present device for printing objects of different curvature are extremely simple.

In this respect, it is necessary only to remove from the member 43 and clamp 47 the previous toothed sector, which is then replaced by a new toothed sector of which the correct operating position, made stable by tightening the screw 45 and clamp 47, is automatically established by its engagement with the rack 52.

The invention is not limited to the single embodiment heretofore described, and modifications and improvements can be made thereto without leaving the scope of the invention, the basic characteristics of which are summarised in the following claims.

What is claimed is:

1. A device for silk screen printing of objects having an elliptical cross-section, said device comprising:

a frame;

a screen support carriage movable in a first direction, said screen support carriage having a toothed rack disposed on a lower side thereof;

an ink knife support carriage movable in a second direction when said screen support carriage is moved in the first direction, said first direction being opposite to said second direction, said ink knife support carriage being positioned above said screen support carriage and having a generally vertical, lateral arm extending downwardly therefrom, said arm having a toothed sector rotatably mounted thereon, said toothed sector being operatively engaged with the toothed rack of said screen support carriage;

a plurality of connecting rods extending from said frame to the said toothed sector to force the ink knife support carriage in the second direction opposite to the first direction in which the screen support carriage moves; and a mandrel for longitudinally gripping the cylindrical objects to be printed, said mandrel being operatively connected to said frame.

2. The device as claimed in claim 1, wherein said mandrel comprises a counter-point and a breech member spaced apart by an adjustable distance, the breech member being slidably mounted on a spindle which is idly mounted on an end of the frame, the opening and closing of said counter-point and breech member being controlled by two separate lever mechanisms which are connected to a common shaft, the common shaft being rotatably mounted on the frame and disposed generally parallel to an axis along which the counter-point and breech member move, the common shaft is driven by a main drive by a further lever mechanism hinged to a lever extending from said common shaft, the longitudinal axis of the lever being arranged to align itself, during printing stages, with an axis on which the frame is pivotably mounted.

3. The device as claimed in claim 1, wherein said toothed sector is in the form of a toothed ring sector which is readily detachable from said arm and is eccentrically positioned relative to a spindle of the mandrel, said toothed ring sector having a pitch circle diameter corresponding to the diameter of the cylindrical surface to be printed and being constantly tangential to a silk screen supported on said screen support carriage, said toothed sector having a coaxial pin rotatably mounted on a clamp, this clamp being adjustable along a longitudinal slot provided in the arm extending from the ink knife support carriage.

4. The device as claimed in claim 1, wherein said toothed rack is generally a horizontal rack having a pitch axis for the toothing which is tangential to the pitch circle diameter of the toothed sector and to a surface of the objects to be printed.

* * * * *